US005341621A

United States Patent [19]

Martelli

[11] Patent Number: 5,341,621

[45] Date of Patent: Aug. 30, 1994

[54] MECHANISM FOR FOLDING A CLOSING FLAP OF A CARTON AND FOR INSERTING THE FLAP INTO A CORRESPONDING OPENING OF THIS CARTON

[75] Inventor: Guglielmo Martelli, Loddington, United Kingdom

[73] Assignee: A.M.R.P. Handels AG, Basek, Switzerland

[21] Appl. No.: 60,594

[22] Filed: May 11, 1993

[30] Foreign Application Priority Data

Jun. 24, 1992 [IT] Italy ..... 92A 000257

[51] Int. Cl.[5] ..... B65B 7/22; B65B 7/26

[52] U.S. Cl. ..... 53/377.5; 53/377.6

[58] Field of Search ..... 53/377.5, 377.6, 491, 53/376.3

[56] References Cited

U.S. PATENT DOCUMENTS

| | | | |
|---|---|---|---|
| 2,340,835 | 2/1944 | Malhiot | 53/377.5 X |
| 2,682,210 | 6/1954 | Bivans | 53/377.5 X |
| 3,462,914 | 8/1969 | Dorfmann | 53/377.5 X |
| 4,244,282 | 1/1981 | Ruzand et al. | 53/377.5 X |
| 4,441,303 | 4/1984 | Langen | 53/377.5 X |
| 4,713,928 | 12/1987 | Tisma | 53/377.5 X |

*Primary Examiner*—Horace M. Culver

*Attorney, Agent, or Firm*—McAulay Fisher Nissen Goldberg & Kiel

[57] ABSTRACT

A mechanism includes an adjusting device designed for changing the position of means for closing the cartons. The displacement of the closing means is made along a vertical direction in accordance with the height of the cartons, and requires a single adjustment action. The closing means comprise a folding member that folds a tab of the flap of each carton, a plate that acts as a guide for inserting the tab into a corresponding opening of the carton, and a pusher member that pushes the tab into the opening.

2 Claims, 3 Drawing Sheets

FIG. 3a
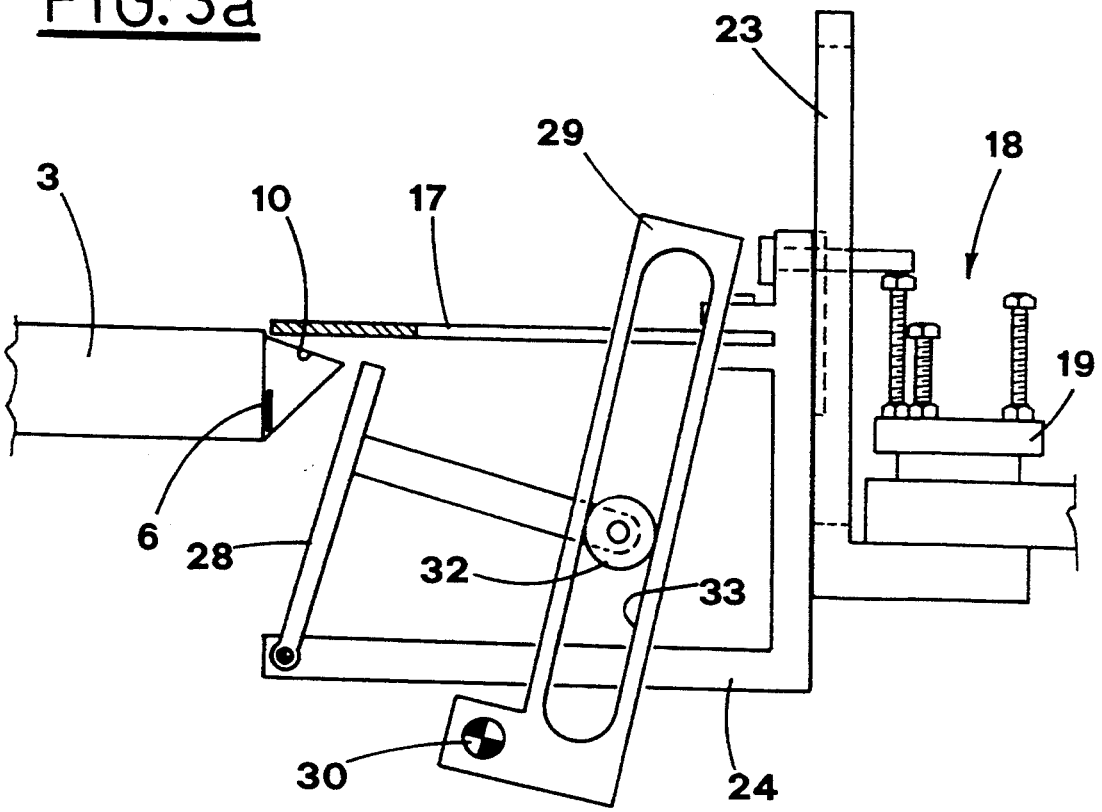
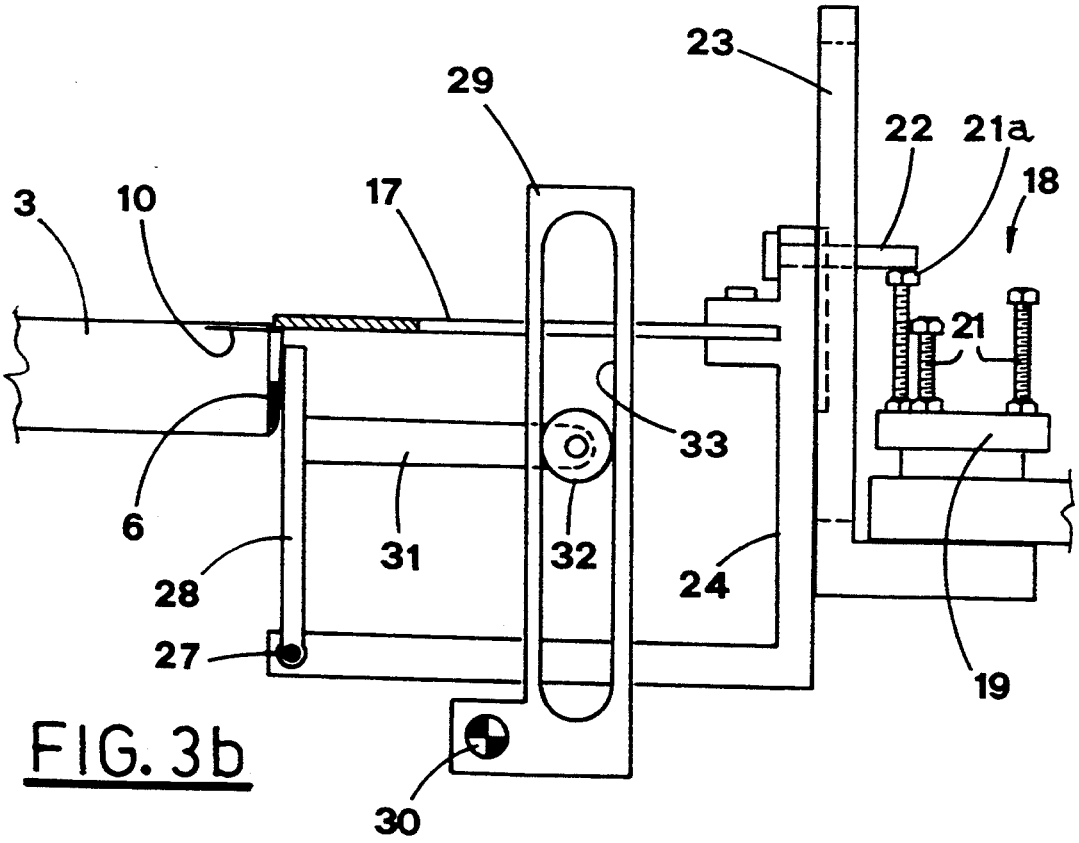
FIG. 3b

MECHANISM FOR FOLDING A CLOSING FLAP OF A CARTON AND FOR INSERTING THE FLAP INTO A CORRESPONDING OPENING OF THIS CARTON

BACKGROUND OF THE INVENTION

The present invention lies in the field concerned with the construction of machines for automatic packaging of goods into related cartons or the like.

Particularly the present invention concernes a mechanism for closing each carton with a related flap that is first folded.

DESCRIPTION OF THE PRIOR ART

It is known that automatic packaging machines after the insertion of the goods into the cartons provide also for closing the cartons.

For this purpose these machines are generally equipped with folding and pushing members which are designed for folding the closing flap of each carton and for inserting it into a corresponding opening made in the carton.

However, there is the need to change the size of the cartons in accordance with kind and dimension of the goods to be packaged. Particularly the change concernes the height of the cartons, that is the vertical extension of the cartons considered when they are oriented in such a way that the opening is turned sidewards.

As a consequence the position of the folding and pushing members, acting on the carton closing flap, must be properly adjusted.

Therefore, various adjustments have to be carried out for different means.

In order to allow these operations, the known machines turns out to be rather complex both in construction and in working, and moreover these complicated adjustment operations provoke a production decreasing and necessitate a great deal of manpower, thus involving high consts.

SUMMARY OF THE INVENTION

The object of the invention is to provide a mechanism intended for folding the closing flap of a carton and for inserting the same folded flap into a corresponding opening, this machine being such that the adjustment operation to be performed when the height of the cartons changes is simplified.

A further object of the invention is to provide a mechanism that requires only one adjustment action for setting its height in accordance with the height of the cartons, even if different means are independently actuated for folding and overfolding the flap of each carton and for inserting the same flap into a related opening.

The above mentioned objects are achieved by means of a mechanism for folding a closing flap of a carton and for inserting the folded flap in a corresponding opening of this carton, said mechanism being located aside of a carton transporting line and including a folding member working in conjunction with a stop member for folding a closing flap of each carton along a fold line, so that a tab of the flap is oriented towards a corresponding opening of the carton, a slab extending in front of the said cartons so as to be adjacent to said cartons, a lower surface of said slab being adapted for guiding said tab being inserted into said opening, and a pushing member reciprocating in a vertical plane transverse to said transporting line, said pushing member being designed for pushing said tab into said opening of the carton.

The claimed mechanism also includes a frame for supporting said slab, with said folding member slidably supported on top of said slab and made to reciprocate in accordance to directions transverse to said transporting line, by actuating means; a plate linked to said actuating means and featuring a vertical slot adapted to receive therein an axle of a roller supported by said folding member and resting slidingly on top of said slab; a pushing member pivoted to said frame; a lever made to reciprocate in circular path and in a vertical plane transverse to said transporting line, said lever featuring a longitudinal slot; an arm extending rearwardly from said pushing member and supporting a roller running in and along said longitudinal slot of said lever; an adjustment device designed for adjusting the vertical position of said frame, so as to adjust, through a single operation, the position of all said members which cooperate for closing said cartons, in accordance with the size of the same cartons.

BRIEF DESCRIPTION OF THE DRAWINGS

The characteristic features of the invention will be pointed out in the following, with reference to the accompanying drawings in which:

FIG. 3*a* and 3*b* show cross section views of the mechanism taken along the line III—III of FIG. 1, respectively in two different operating phases.

DESCRIPTION OF THE PREFERRED EMBODIMENT

Figure 1:
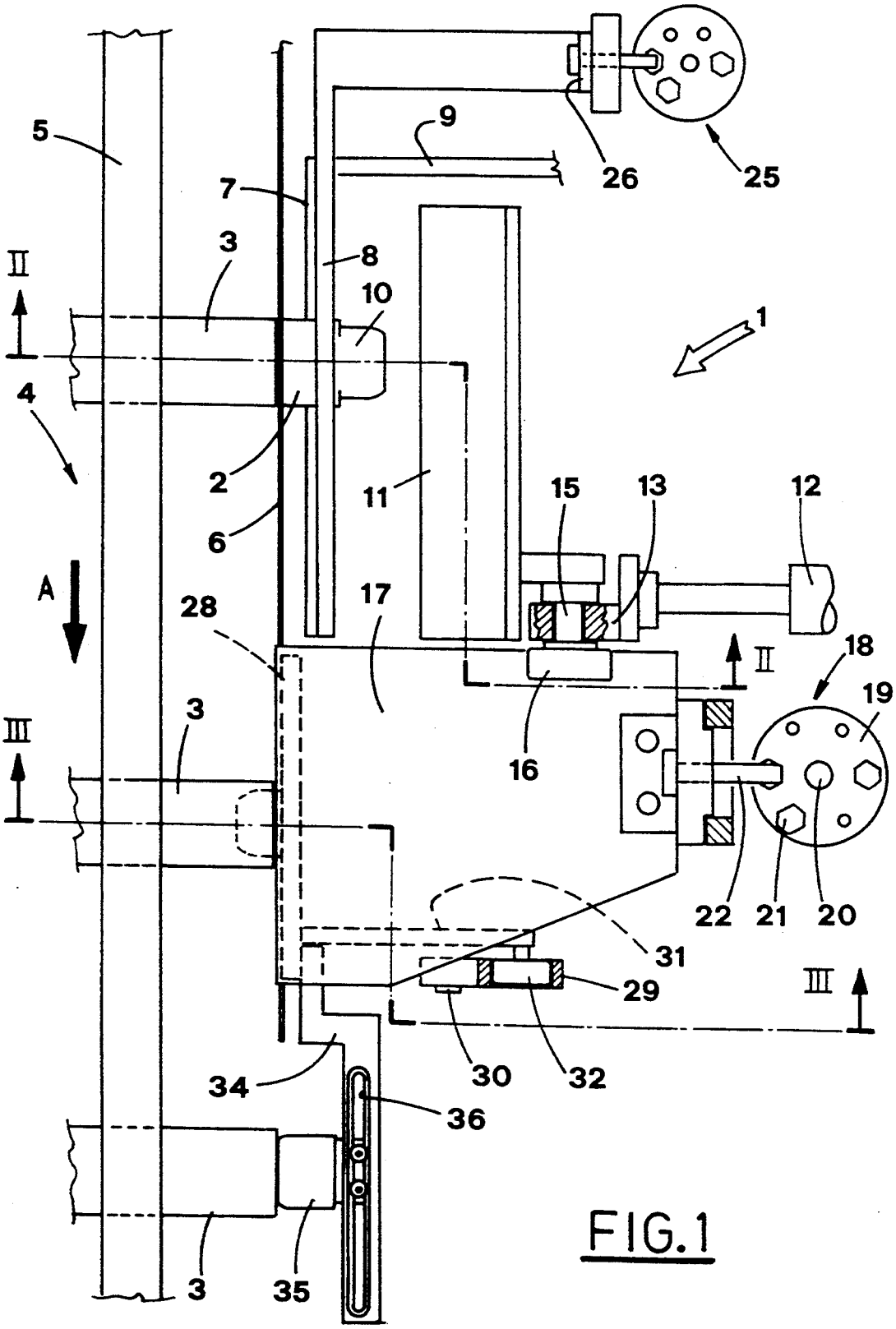
FIG. 1 is a plan view of the mechanism that is the subject of the present invention.

Referring to the above figures, reference numeral 1 generally indicates a mechanism that is designed for folding the closing flap 2 of a carton 3, and for inserting the folded flap 2 into a corresponding opening of the carton.

The cartons 3 are first filled with goods and then made to move along a transporting line 4, in accordance with the direction indicated by the arrow A.

The cartons are oriented crosswise with respect to the transporting line 4, and there is a longitudinal guide parallel to the line 4, that engages the top of each carton.

Aside of the transporting line 4, there is a further guide 6 that includes a longitudinal strap extending in front of the cartons 3, so that it holds the counterfacing dust flaps of each carton lying in the cross-plane of the carton opening.

Aside of the transporting line 4 there is also located a first folding member 7, that cooperates with the mechanism 1. The first folding member 7 raises the flap 2 of each carton until it strikes against a stop member 8 parallel to the transporting line 4.

The folding member 7 includes a circular cross-section bar that is parallel to the transporting line 4 and that can be moved vertically under the action of means which are not shown.

The circular cross-section bar is linked to these means through a transverse arm 9.

Figure 2A:
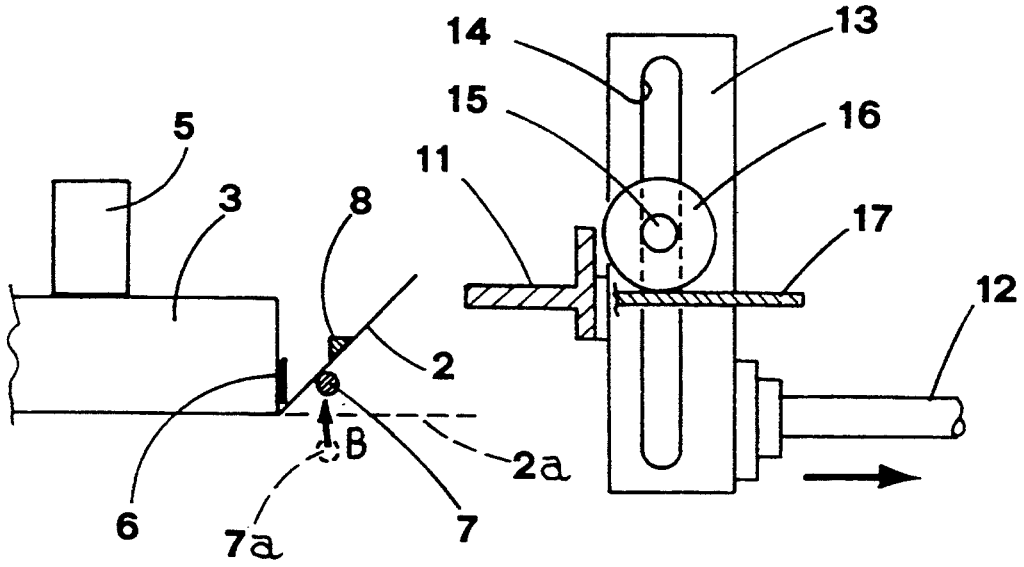
FIG. 2*a* and FIG. 2*b* show cross section views of the mechanism taken along the line II—II of FIG. 1, respectively in two different operating phases.

Particularly, the folding member 7 can be moved between a lowered position 7*a*, that is located at a height lower than the height of the transporting line upon which the cartons are moved, and a raised position in which the flap 2 of each carton is folded (see FIG. 2*a*).

The stop member 8 includes a triangular cross-section bar arranged in a way such that one of its flat surfaces faces the flap 2 that has been raised by the folding member 7.

Furthermore, the triangular cross-section bar is so positioned that an edge of the just mentioned flat surface is adjacent to a folding line made along each flap 2, so as to delimit a tab 10 to be folded.

A second folding member 11 works in conjunction with the stop member 8 for folding the flap 2 of each carton 3 along the above mentioned folding line, so that the tab 10 of the flap is folded towards the opening of the related carton.

The second folding member 11, that is operated in suitable time relation with the first folding member 7, includes a plate parallel to the transporting line 4 and extending in a horizontal plane located higher than the stop means 8. The second folding member 11 is made to reciprocate, transversally with respect to the transporting line 4, by ajack 12.

More precisely, the stem of the jack 12 is connected to a plate 13 that has a vertical slot 14. An axle 15, made integral with the folding member 11 and supporting an idle roller 16, passes through the slot 14, so that the rotational axis of the roller is parallel to the transporting line 4.

The roller 16 rests upon, and slides on, the upper surface of a horizontal slab 17 that is located downstream of the folding member 11 and that extends so as to touch the front ends of the cartons 3 moved along the transporting line 4.

As it will be better explained in the following, the lower surface of the slab 17 is adapted to act as a guide for the tab 10 of the cartons 3, while the same tab is being introduced into the carton opening. The position of the slab 17 can be adjusted by means of a device 18 that allows variation of the vertical distance between the slab and a horizontal datum plane.

Preferably this adjustment device includes a disk plate 19 that is rotatable about a vertical axis 20, and that bears a plurality of stop means 21 located along its periphery.

The stop means 21 include threaded stems which have different length and which are vertical. The upper head of each stem 21 is aimed at stopping a tailpiece 22 of a frame 24 that can slide along vertical guides 23 which include a pair of uprights. The upper part of the frame 24 supports the slab 17.

A similar device is provided for adjusting the vertical position of the stop member 8 that is made integral with a slide 26 that can move and is guided in vertical direction. Under the slab 17, there is a pushing member 28 that is connected to lower part of the frame 24 and that pivots upon a pin 27 fastened to the frame 24. The pushing member 28 is designed for carrying out the insertion of the tab 10 into the related carton opening.

The pushing member 28 is made to reciprocate by a lever 29 that is in turn made to reciprocate in a circular path about a fixed fulcrum 30, in a plane transverse to the transporting line 4.

An arm 31 is made integral with the back side of the pushing member 28 and is perpendicular thereto. The free end of the arm 31 supports an idle roller 32 that runs inside and along a longitudinal slot 33 made in the lever 29.

An appendix 34 extends from the pushing member 28 so as to be parallel to the advancement direction A of the transporting line 4. The appendix 34 supports a pad 35 for pushing the flap 2 in order to complete the insertion of the tab 10 after that the related carton has disengaged from the strap 6.

The pad 35 is adjustably-fixed so as to pass through the slot 36 of the appendix 34. The cartons 3 to be closed are positioned on top of the transporting line 4 in such condition so that the flap 2 is horizontal, as it is shown by the phantom line 2*a* in FIG. 2*a*.

The first folding member 7 is then operated so that it moves from the lowered position 7*a* to the raised position, thus folding the flap 2 that is kept in abutment onto the stop member 8 (as indicated by the arrow B).

Figure 2B:
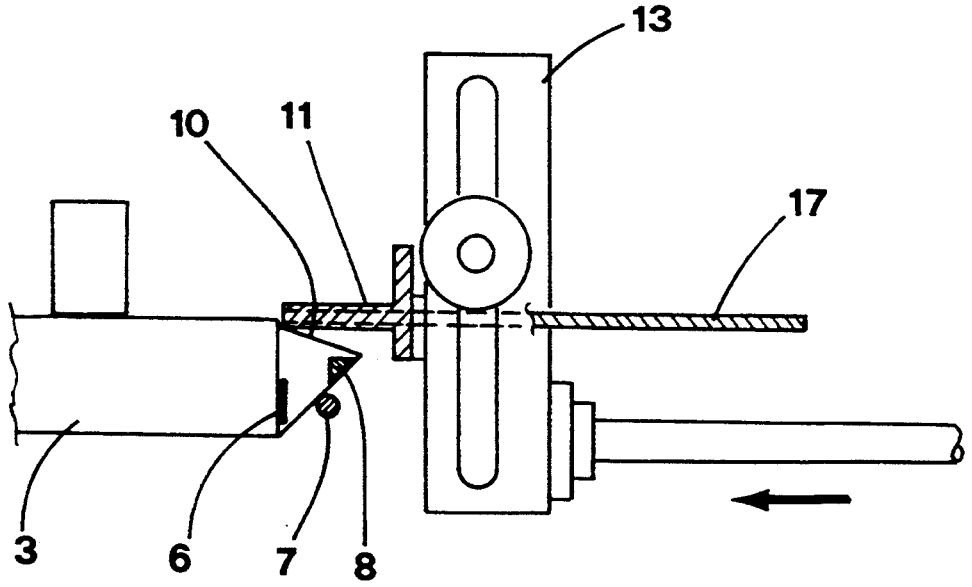

Then the second folding member 11 is operated, in a proper time relation, by the jack 12, thus overfolding the flap 2 along the folding line, so that the tab 10 is oriented towards the opening of the carton, as it is shown in FIG. 2*b*. As a consequence, the tab 10 takes a good position for being properly inserted into the carton opening.

Upon advancement of the carton 3, the folded flap 2 disengages from the stop means 8 and from the folding members 7, 11, and takes a position under the slab 17 such as shown in FIG. 3. The slab 17 keeps the tab 10 of the flap 2 in this position for introduction.

It should be noted that the lower surface of the slab 17 lies in a plane that is slightly higher than the lower surface of the folding member 11, so that a jamming of the tab 10 is avoided when it leaves one of these surfaces and engages with the other one.

The oscillatory motion of the pusher 28, that is moved by the lever 29, causes the tab 10 to be inserted into the carton opening, as it can be seen in FIG. 3*b*. During the introduction phase the tab 10 is guided by the lower surface of the slab 17.

Lastly the pad 35, moved in synchrony with the pushing member 28, completes the closing of the carton when the carton has left the strap 6.

When the carton must be changed to higher ones, the vertical position of the frame 24 supporting the slab 17 is adjusted accordingly. To do this, after raising the tailpiece 22, the disk plate 19 must be rotated until the porper stem 21 is lined up with the tailpiece. The tailpiece 22 is then brought in abutment onto this stem, so that it rests onto the stem head 21*a* under the action of gravity.

In this way the slab 17 is moved up to a position in which its lower surface, when at the position of operation, is located at a height slightly lower than the height of the upper ends of the cartons.

The displacement of the slab 17 causes the folding member 11 to be also moved, because this member is kept resting onto the slab through the roller 16 while the slot 14 of the plate 13 allows the folding member to move vertically.

The plate 13 serves for transmitting the reciprocating motion generated by the jack 12. The adjustment of the frame 24 position causes the pusher member 28 to be also moved, since it is connected to the frame.

The roller 32 supported by the pusher member 28 moves along the slot 33 made in the lever 29, so that the radial distance between the roller and the fulcrum 30 is changed and also the stroke of the pushing member 28 is varied accordingly.

By means of a single adjustment operation performed by the device 18, it is possible to adjust, at the same time, the position of the members which cooperate for closing the cartons.

The position of the folding member 11, that overfolds the tab 10 of the carton closing flap 2, the position of the slab 17, that acts as a guide for the tab 10 being inserted into the corresponding opening, and the position of the pushing member 28, that pushes the tab 10 into the opening, are then simultaneously adjusted.

The adjustment of the mechanism in accordance with the various sizes of the cartons, is therefore very easy, and this fact brings obvious advantages as far as productivity and working of the machine are concerned.

Obviously the adjustment device can be other than the one just described and may be provided with hydraulic or electro-mechanical means, or other similar actuators designed for changing the position of the frame 24, in the same way as previously described.

Summarizing, the described mechanism carries out four successive operations:

folding the tab 10 by means of the folding member 11, so that the tab 10 is positioned in front of the carton opening (see FIG. 2*b*);

keeping the tab 10 in such position by means of the slab 17 (see FIG. 3*a*);

partial insertion of the tab 10 into the opening, carried out by the pushing member 28 (see FIG. 3*b*);

completition of the inserting operation carried out by the pad 35 (see FIG. 1).

It should be enphasized that the folding member 11 is operated by means which work independently from the pushing member operating means, while their adjustment as well as the adjustment of the position of the slab, are carried out through a single operation when the carton size is changed.

All this is made possible because of the particular shape of the mechanism elements, as well as because of the original technical-functional combination of the same elements.

It is obvious that what has been described above is only illustrative, therefore all possible constructive variants are within the protection of the innovation as claimed in the following.

What is claimed is:

1. In a mechanism for folding a closing flap of a carton and for inserting the folded flap in a corresponding opening of this carton, said mechanism being located aside of a carton transporting line and including a folding member working in conjuction with a stop member for folding a closing flap of each carton along a fold line, so that a tab of the flap is oriented towards a corresponding opening of the carton, a slab extending in front of the said cartons so as to be adjacent to said cartons, a lower surface of said slab being adapted for guiding said tab being inserted into said opening, and a pushing member reciprocating in a vertical plane transverse to said transporting line, said pushing member being designed for pushing said tab into said opening of the carton;

a frame for supporting said slab, with said folding member slidably supported on top of said slab and made to reciprocate in accordance to directions transverse to said transporting line, by actuating means;

a plate linked to said actuating means and featuring a vertical slot adapted to receive therein an axle of a roller supported by said folding member and resting slidingly on top of said slab;

a pushing member pivoted to said frame;

a lever made to reciprocate in circular path and in a vertical plane transverse to said transporting line, said lever featuring a longitudinal slot;

an arm extending rearwardly from said pushing member and supporting a roller running in and along said longitudinal slot of said lever;

an adjustment device designed for adjusting the vertical position of said frame, so as to adjust, through a single operation, the position of all said members which cooperate for closing said cartons, in accordance with the size of the same cartons.

2. Mechanism as claimed in claim 1, wherein a longitudinal appendix extends rearwardly, with respect to an advancement direction for said transporting line, from said pushing member, said appendix supporting a pad designed to complete the insertion of said tab after that the carton has disengaged from a strap adapted for keeping the counterfacing dust flaps previously folded in the cross-plane of the carton opening.

* * * * *